US005245154A

United States Patent [19]

Sato et al.

[11] Patent Number: 5,245,154

[45] Date of Patent: Sep. 14, 1993

[54] METHOD AND APPARATUS FOR HEATING A WOOD MATERIAL

[75] Inventors: Takashi Sato; Shigeru Morishita; Kenichi Ehara, all of Osaka, Japan

[73] Assignee: Daiken Trade & Industry Co., Ltd., Toyama, Japan

[21] Appl. No.: 759,595

[22] Filed: Sep. 16, 1991

[30] Foreign Application Priority Data

Sep. 18, 1990 [JP] Japan ..... 2-249769
Sep. 18, 1990 [JP] Japan ..... 2-249770

[51] Int. Cl.[5] ..... H05B 6/54

[52] U.S. Cl. ..... 219/10.81; 219/10.57; 219/10.61 R; 219/10.75; 34/1 K; 156/380.2; 156/380.6

[58] Field of Search ..... 219/10.81, 10.61 R, 219/10.57, 10.69, 10.75, 10.41, 10.53; 34/1 K, 1 R; 156/380.2, 380.6, 274.6, 274.8, 245

[56] References Cited

U.S. PATENT DOCUMENTS

| | | | |
|---|---|---|---|
| 2,307,344 | 1/1943 | Zottu | 219/10.81 |
| 2,325,652 | 8/1943 | Bierwirth | 219/10.81 |
| 2,472,708 | 6/1949 | Jones, Jr. | 219/10.81 |
| 2,543,618 | 2/1951 | Wood | 219/10.81 |
| 3,444,275 | 5/1969 | Willett | 219/10.81 |
| 4,366,020 | 12/1982 | Overlack | 219/10.81 |
| 4,406,070 | 9/1983 | Preston | 34/1 |
| 4,692,581 | 9/1987 | Mizutani et al. | 219/10.81 |
| 4,801,778 | 1/1989 | Mizutani et al. | 219/10.81 |

FOREIGN PATENT DOCUMENTS

| | | |
|---|---|---|
| 2-81603 | 3/1990 | Japan . |
| 2-81604 | 3/1990 | Japan . |
| 2-81605 | 3/1990 | Japan . |

*Primary Examiner*—Bruce A. Reynolds
*Assistant Examiner*—Tu Hoang
*Attorney, Agent, or Firm*—Sixbey, Friedman, Leedom & Ferguson

[57] ABSTRACT

A wood material, into which a synthetic resin solution or the like is injected, is held from its surface and back by heating plates in a closed container. The inside of the heating plate is provided with a heating medium passageway through which a heating medium can flow. A heating medium tank is connected to the heating medium passageway through a heating medium feeding passageway and a circulating pump. Warm water or steam are fed to the heating medium passageway. The warm water or steam have the temperature which can volatilize a medium from the heating medium tank or can volatilize the injected solution. A vacuum pump is connected to the closed container. The pressure is reduced in the closed container correspondingly to the operation of the vacuum pump.

12 Claims, 3 Drawing Sheets

METHOD AND APPARATUS FOR HEATING A WOOD MATERIAL

BACKGROUND OF THE INVENTION

The present invention relates to a method and an apparatus for heating a wood material.

Conventionally, there has been adopted a method for injecting a synthetic resin solution or various drugs into the wood material, and then heating the wood material so as to cure the injected solution therein in order to obtain a reformed wood which has improved dimensional stability, weather resistance and the like.

There have been known a method for directly heating the wood material by a hot air dryer, a hot press and the like, and a method for heating the wood material by dielectric heating means such as high frequencies or microwaves in order to heat and cure the solution injected into the wood material such that the reformed wood can be obtained.

In the case where the wood material having the injected solution is heated by heating means such as the hot air dryer or the hot press, however, there is caused a problem that cracks, warps, deflections, kinks, collapses and the like occur when the injected solution is cured. In addition, when a solvent is volatilized, the injected solution flows out of the wood material so that the residual rate of the injected solution is reduced. Consequently, reforming effects are lowered, and the curing defects of the injected solution are caused. In the case where a thick wood material is subjected to a heat treatment, particularly, the above-mentioned problems become more remarkable.

In the case where the injected solution is cured, the cracks and the like are caused for the following reasons. When the wood material is heated, the solvent in the wood material is rapidly transferred. Consequently, there is increased the difference of solvent content between the central portion and the surface layer portion of the wood material. Thus, there is caused the difference of shrinkage stress between the central portion and the surface layer portion of the wood material, or the irregular shrinkage of the wood material. In addition, the synthetic resin solution in the surface layer portion is cured more quickly than in the central portion, so that the solvent remaining in the central portion is prevented from being discharged out of the wood material. Consequently, explosions are caused by the steam pressure in the central portion of the wood material.

On the other hand, when the wood material is heated by the dielectric heating means such as high frequencies or microwaves, the wood material is dielectrically heated from its inside. Consequently, the injected solution is also cured from the inside of the wood material. Thus, the above-mentioned problems are eliminated. In the case where only the dielectric heating means is used, however, a temperature tends to be increased and decreased in the vicinity of plus and minus electrode plates, respectively. As a result, there is caused the unevenness of temperature owing to the arrangement of the electrode plates. Consequently, curing defective portions are generated. In addition, there is increased the density of the solvent as a component of the injected solution.

The present inventors have proposed that external heating means such as a heating plate having a heating wire is used together with the dielectric heating means (see Japanese Patent Application No. 326443/89). However, there are caused the following problems. More specifically, a lead wire and the heating wire of the heating plate generate heat owing to high frequencies, so that the heating plate is damaged. In addition, the influence of the high frequencies is transmitted to other equipments through the lead wire.

In the case where the solution containing a combustible solvent is to be injected into the thick wood material, a heating temperature for curing the injected solution in the wood material should be increased because of the great thickness of the wood material. Consequently, the solvent may cause fires or explosions.

In the cases where the wood material is heated to cure the injected solution therein and where the wood material is heated to evaporate water therein such that it is dried, the above-mentioned problems are caused.

SUMMARY OF THE INVENTION

To solve the above-mentioned problems, it is an object of the present invention to reform or dry a wood material without deformation.

To achieve the above-mentioned object, the present invention provides a method for heating a wood material comprising steps of holding the wood material, into which a synthetic resin solution or the like is injected, from its surface and back in a closed container by heating plate having heating medium passageways through which a heating medium can flow, volatilizing the solvent from the injected solution in the wood material by reducing the pressure in the closed container and by making a solvent volatilizing heating medium flow through the heating medium passageways, the solvent volatilizing heating medium having the temperature which can volatilize the solvent of the injected solution, and acuring the injected solution in the wood material by making an injected solution curing heating medium flow through the heating medium passageways, the injected solution curing heating medium having the temperature which is higher than that of the solvent volatilizing heating medium and can cure the injected solution.

When the pressure is reduced in the closed container and the solvent volatilizing heating medium having the temperature, which can volatilize the solvent of the injected solution, flows through the heating medium passageways, the injected solution in the wood material is heated to the temperature, at which the solvent is volatilized, by the heating plates having the increased temperature in the state of pressure reduction. Consequently, the solvent of the injected solution is smoothly volatilized from the wood material, so that the residual rate of the solvent is reduced. Thus, the reforming effects of the wood material is improved and it is hard to generate the curing defective portions of the injected solution.

When the injected solution curing heating medium having the temperature, which is higher than that of the solvent volatilizing heating medium and can cure the injected solution, flows through the heating medium passageways, the injected solution in the wood material is heated to the temperature, which is higher than that of the solvent volatilizing heating medium and can cure the injected solution, because the wood material is held by the heating plates which are heated by the injected solution curing heating medium. Consequently, the injected solution can be cured surely. Since the wood material is heated from its surface and back by the heating plates gradually or by stages, the unevenness of heating is eliminated so that the wood material is uniformly heated. Consequently, it is hard to generate the curing defective portions of the injected solution. In addition, the wood material is heated with being held from its surface and back by the heating plates. As a result, it is hard to cause the deformation of the wood material such as warps or deflections.

Even if the solvent of the injected solution is combustible, the wood material is heated through the heating medium which flows through the heating medium passageways. Consequently, there is no possibility that fires are caused or the solvent is exploded when heating the wood material.

If the temperature of the heating medium, which is fed to the heating medium passageway of the heating plate, is changed, the steps of volatilizing the solvent and of curing the injected solution can continuously be carried out. Consequently, the heat treatment for the wood material can smoothly be performed.

In the case where the solvent is to be volatilized from the injected solution in the wood material, it is preferred that high frequencies are continuously or intermittently oscillated to the wood material so as to dielectrically heat the wood material. Thus, the wood material is dielectrically heated from its inside by the high frequencies, so that the solvent is transferred from the central portion to the surface layer portion of the wood material. The wood material is heated from its surface and back by the heating plates. As a result, the solvent transferred to the surface layer portion can be volatilized therefrom efficiently and smoothly. Thus, the reforming effects of the wood material can be improved still more. In addition, it becomes harder to generate the curing defective portions of the injected solution. In this case, it is particularly preferred that the solvent is discharged out of the wood material in accordance with the inclination of the content of the solvent by increasing or decreasing the temperature of the heating plates, the pressure reduction in a pressure reducing container, the strength of the high frequency of a high-frequency oscillator and the like. Consequently, it is especially hard to cause the deformation of the wood material such as cracks, warps or kinks.

In the case where the injected solution in the wood material is to be cured, it is also preferred that the high frequencies are continuously or intermittently oscillated to dielectrically heat the wood material. Thus, the wood material is dielectrically heated from its inside by the high frequencies. Consequently, the injected solution is uniformly cured from the central portion to the surface layer portion of the wood material. Accordingly, explosions can be prevented from being caused by the steam pressure of the solvent which remains in the central portion of the wood material.

The present invention provides another method for heating a wood material comprising steps of holding the wood material from its surface and back in a closed container by heating plates having heating medium passageways through which a heating medium can flow, and drying the wood material by reducing the pressure in the closed container, by making the heating medium having the temperature, which can volatilize the water in the wood material, flow through the heating medium passageways, and by continuously or intermittently oscillating high frequencies to the wood material.

When the high frequencies are continuously or intermittently oscillated to the wood material so as to dielectrically heat the wood material, the water is quickly transferred from the central portion to the surface layer portion of the wood material. When the wood material is heated by the heating plates in the state of pressure reduction, the water transferred to the surface layer portion of the wood material is evaporated most smoothly without causing the deformation of the wood material such as cracks or warps. The heating plate has its temperature increased by the heating medium having the temperature which can volatilize the water in the wood material.

The present invention provides an apparatus for heating a wood material comprising a plurality of heating plates provided with heating medium passageways, through which a heating medium can flow, for holding the wood materials from their surfaces and backs, a closed container for housing the heating plates which hold the wood materials, pressure reduction means for reducing the pressure in the closed container, and heating medium feeding means capable of adjusting a heating temperature which is provided outside the closed container for selectively feeding the heating media having different temperatures to the heating medium passageways through feed pipes.

In the case where the wood material is to be heated by the heating plates with being held from its surface and back, it can be kept in the state of pressure reduction and the heating media having the different temperatures can selectively be fed to the heating plates. Consequently, the wood material can be heated on the optimum conditions corresponding to the quality or thickness of the wood material, and the kind or evaporative temperature of the liquid in the wood material. Thus, the wood material can be reformed or dried without deformation.

The present invention provides another apparatus for heating a wood material comprising a plurality of heating plates provided with heating medium passageways, through which a heating medium can flow, for holding the wood materials having the injected synthetic resin solution or the like from their surfaces and backs, a closed container for housing the heating plates which hold the wood materials, pressure reduction means for reducing the pressure in the closed container, solvent volatilizing heating medium feeding means for feeding to the heating medium passageways a solvent volatilizing heating medium having the temperature which can volatilize the solvent of the injected solution, injected solution curing heating medium feeding means for feeding to the heating medium passageways an injected solution curing heating medium having the temperature which can cure the injected solution, and control means for controlling the solvent volatilizing and injected solution curing heating medium feeding means such that the solvent volatilizing or injected solution curing heating medium can selectively be fed to the heating medium passageways.

When the pressure is reduced in the closed container and the solvent volatilizing heating medium flows through the heating medium passageways, the solvent of the injected solution can be volatilized from the wood material smoothly and efficiently. Consequently, the residual rate of the solvent can be reduced without causing the deformation of the wood material such as cracks or warps. Thus, the reforming effects of the wood material can be improved. In addition, it is hard to cause the curing defective portions of the injected solution.

When the injected solution curing heating medium flows through the heating medium passageways, the wood material can be heated from its surface and back by the heating plates. Consequently, there is eliminated the unevenness of heating so that the wood material can uniformly be heated. Thus, it is hard to cause the curing defective portions on the wood material. The wood material can be heated with being held by the heating plates. As a result, it is hard to cause the deformation of the wood material such as warps or deflections.

When the solvent volatilizing and injected solution curing heating media having the different temperatures are continuously fed to the heating medium passageways, the steps of volatilizing the solvent and of curing the injected solution can serially be carried out. Consequently, the wood material can be heated smoothly and quickly.

It is preferred that the above-mentioned apparatuses further comprise high-frequency oscillating means for oscillating high frequencies to the wood material held by the heating plates so as to dielectrically heat the wood material. Thus, the wood material is dielectrically heated, so that the liquid can be transferred from the central portion to the surface layer portion of the wood material. In addition, when the surface layer portion of the wood material is heated by the heating plates, the liquid transferred to the surface layer portion of the wood material can be evaporated most smoothly without causing the deformation of the wood material such as cracks or warps. Consequently, the wood material can be dried or the injected solution in the wood material can be cured efficiently. In this case, the heating plates are heated by means of the heating medium which flows through the heating medium passageways. Even if the high frequencies are oscillated by the high-frequency oscillating means, therefore, the heating plates are not damaged by the high frequencies.

The present invention provides yet another apparatus for heating a wood material comprising a plurality of heating plates provided with heating medium passageways, through which a heating medium can flow, for holding the wood materials from their surfaces and backs, a closed container for housing the heating plates which hold the wood materials, pressure reduction means for reducing the pressure in the closed container, heating medium feeding means for feeding the heating medium to the heating medium passageways, and high-frequency oscillating means for oscillating high frequencies to the wood material held by the heating plates so as to dielectrically heat the wood material.

The above-mentioned apparatus comprises the heating plates, the pressure reduction means and the high-frequency oscillating means. Consequently, the wood material is dielectrically heated so that the liquid can quickly be transferred from the central portion to the surface layer portion of the wood material. In addition, the liquid transferred to the surface layer portion can be evaporated therefrom. As a result, the liquid in the central portion of the wood material can smoothly be evaporated in similar to the foregoing.

The wood material is dielectrically heated by the high-frequency oscillating means with being held from its surface and back by the heating plates. Consequently, it is hard to cause the deformation such as warps or distortions still more.

The heating plates are heated by means of the heating medium which flows through the heating medium passageways. Even if the high frequencies are oscillated by the high-frequency oscillating means, therefore, the heating plates are not damaged by the high frequencies. Accordingly, the wood material can smoothly be heated without causing its deformation such as warps or distortions and damaging the heating means.

It is preferred that the above-mentioned apparatus further comprises pressure fastening means for fastening the heating plates, which hold the wood materials, from their surfaces and backs by pressures. Thus, there are generated no gaps between the heating plates which hold the wood material, between the wood material and the heating plate, and between the wood materials. Consequently, the deformation of the wood material such as warps or kinks can be prevented still more.

These and other objects, features and advantages of the present invention will become more apparent upon a reading of the following detailed description and drawings.

DETAILED DESCRIPTION OF A PREFERRED EMBODIMENT

A preferred embodiment of the present invention will be described with reference to the drawings.

Figure 1:
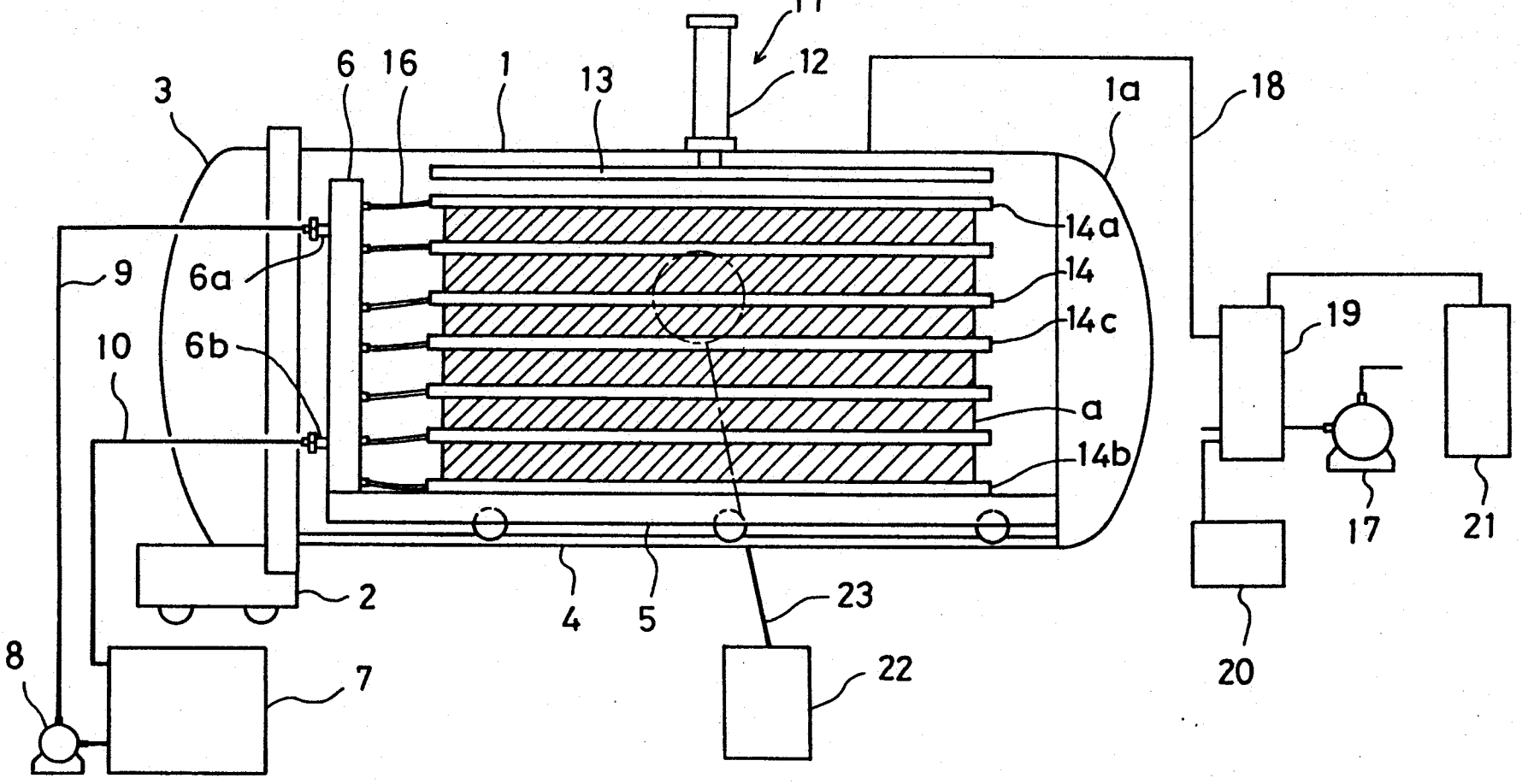
FIG. 1 is a view showing the whole structure of an apparatus for heating a wood material according to an embodiment of the present invention.

FIG. 1 shows the whole structure of an apparatus for heating a wood material according to an embodiment of the present invention. In FIG. 1, at 1 is indicated a cylindrical closed container which is extended longitudinally (laterally in FIG. 1). The rear end portion (on the right side in FIG. 1) of the closed container 1 is covered by a closing mirror plate 1*a*. The front end portion (on the left side in FIG. 1) of the closed container 1 can be opened and closed by a lid body 3. The lid body 3 is a mirror plate which is mounted on a truck 2. The truck 2 can be moved longitudinally.

A guide rail 4 is provided in the inner bottom portion of the closed container 1. The guide rail 4 is extended longitudinally. A truck 5 is provided on the guide rail 4 so as to be freely moved longitudinally. The front end portion of the truck 5 is connected to the lid body 3 through a connecting member (not shown). The truck 5 is longitudinally moved interlockingly with the opening and closing of the lid body 3.

A heating medium header 6 is provided on the top face of the front end portion of the truck 5. A heating medium tank 7 is provided as a heating medium feeder in an externally proper portion of the closed container 1. The heating medium feeding side of the heating medium tank 7 is connected to a medium introduction portion 6*a* of the heating medium header 6 through a heating medium feeding passageway 9 having a circulating pump 8. The heating medium feedback side of the heating medium tank 7 is connected to a medium flowing portion 6*b* of the heating medium header 6 through a heating medium feedback passageway 10. The heating medium tank 7, circulating pump 8, heating medium feeding passageway 9 and heating medium feedback passageway 10 form solvent volatilizing heating medium feeding means and/or injected solution curing heating medium feeding means.

Pressure fastening means 11 is provided in the upper central portion of the closed container 1. The pressure fastening means 11 includes a hydraulic cylinder 12 and a horizontal press plate 13. The hydraulic cylinder 12 is fixed to the upper central portion of the closed container 1. The horizontal press plate 13 is provided in the upper inner portion of the closed container 1. The top face of the horizontal press plate 13 is fixed to the tip of a rod of the hydraulic cylinder 12 which penetrates the upper wall face of the closed container 1 in the state of airtight. The horizontal press plate 13 can vertically be moved correspondingly to the operation of the hydraulic cylinder 12.

On the truck 5 are provided a plurality of wood materials W which are respectively sandwiched between heating plates 14. The heating plates 14 and wood materials W are held by the horizontal press plate 13 which falls down, and the truck 5.

The pressure fastening means 11 is not limited to the above-mentioned structure, but may be a clamp or the like having the structure in which the laminated wood materials W are pressed against the truck 5 so as to be prevented from being deformed during heating.

Figure 2:
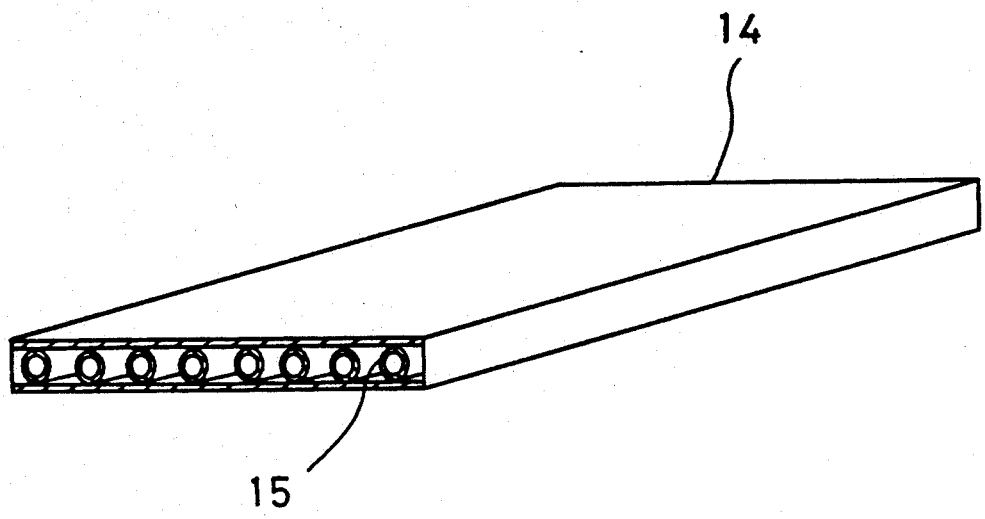
FIG. 2 is a perspective view of a heating plate of the heating apparatus.
Figure 3:
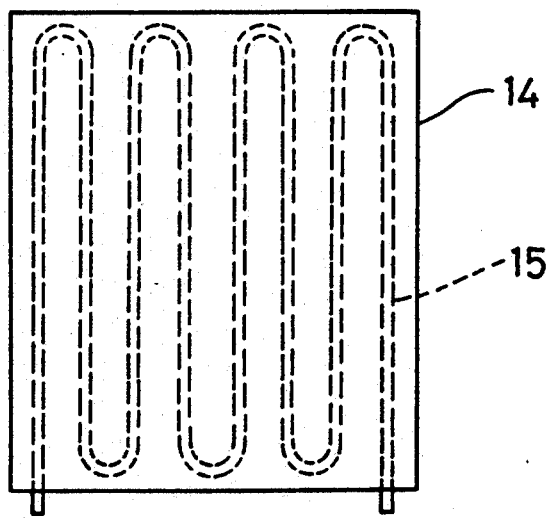
FIG. 3 is a plan view of the heating plate of the heating apparatus.

As shown in FIGS. 2 and 3, the heating plate 14 is formed like a hollow box by a metal plate such as an aluminum plate which is excellent in heat conductivity. A heating medium passageway 15 is provided in the hollow portion of the heating plate 14. The heating medium passageway 15 is comprised of a copper pipe or the like which is curved in a zigzag line. The upstream and downstream ends of the heating medium passageway 15 are removably connected to the heating medium header 6 through flexible connection pipes 16. The flexible connection pipe 16 is mace of an insulating material such as polytetrafluoroethylene (trade name: Teflon).

A vacuum pump 17 is provided as pressure reduction means in the externally proper portion of the closed container 1. The suction side of the vacuum pump 17 is connected to the inside of the closed container 1 through a suction pipe 18. A heat exchanger 19 is provided in the middle of the suction pipe 18. A condensate tank 20 and a cooler 21 are connected to the heat exchanger 19 through piping.

Figure 4:
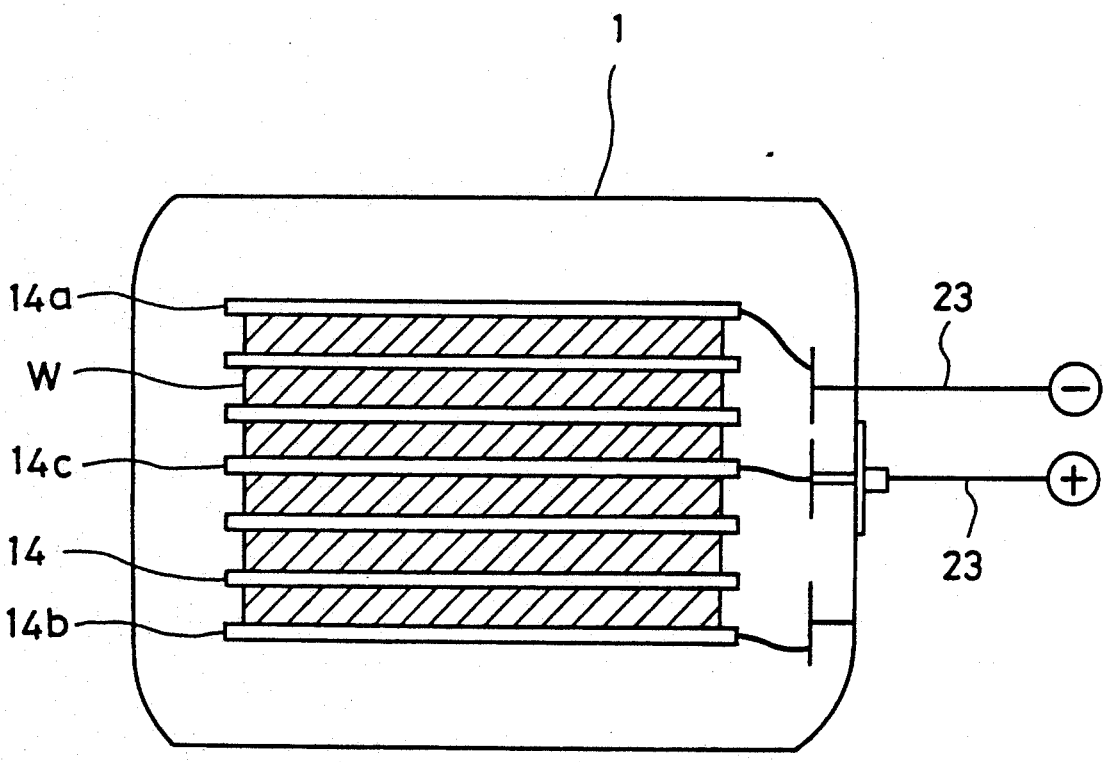
FIG. 4 is a schematically longitudinal section view of a closed container of the heating apparatus.

A high-frequency oscillator 22 is provided in the externally proper portion of the closed container 1. The heating plate 14 also serves as an electrode plate for applying high frequency electric field to the wood material W. As shown in FIG. 4, the uppermost and lowermost heating plates 14*a* and 14*b* are connected to the negative electrode of the high-frequency oscillator 22 by a conductor 23. A central heating plate 14*c* is connected to the positive electrode of the high-frequency oscillator 22 by the conductor 23. Other heating plates 14 are free electrode plates.

There will be described a method for heating a planer wood material W having a comparatively great thickness by means of the above-mentioned heating apparatus.

A drug such as antiseptics, insecticides or flame retarder, a synthetic resin solution or the like is injected into the suitable wood material W such as a lumbering product, plywood, LVL or veneer. Then, the wood material W is mounted on the truck 5 with being held by the heating plates 14. The heating plates 14 are provided on the upper and lower sides of the wood material W. The above-mentioned operation can be carried out as follows. More specifically, the lid body 3 of the closed container 1 is opened forward to pull the truck 5 out of the closed container 1 along the guide rail 4. Then, the lowermost heating plate 14*b* is mounted on the truck 5. The wood materials W and other heating plates 14 are alternately laminated on the heating plate 14*b* so as to form a lamination. Thereafter, the upstream and downstream ends of the heating medium passageway 15 of the heating plate 14 are connected to the heating medium header 6 through the flexible connection pipes 16. Subsequently, the lid body 3 is moved backward to house the truck 5 having the lamination in the closed container 1. Then, a side door (not shown) on the side portion of the closed container 1 is opened to connect the conductors 23 of the high-frequency oscillator 22 to the heating plates 14*a*, 14*b* and 14*c* as the electrode plates.

Then, the hydraulic cylinder 12 is operated to make the horizontal press plate 13 fall down. Consequently, the lamination comprised of the wood materials W and the heating plates 14, which is housed in the closed container 1, is held by the horizontal press plate 13 and the truck 5.

Thereafter, the vacuum pump 17 is operated to reduce the pressure in the closed container 1 to 100 Torr or less, preferably 30 to 60 Torr. The circulating pump 8 is operated to feed and circulate the warm water, which is heated to 30° to 60° C. in the heating medium tank 7, from the heating medium feeding passageway 9 to the heating medium passageway 15 in the heating plate 14 through the heating medium header 6.

With the above-mentioned structure, the water is controlled to have its temperature continuously increased or decreased from an ordinary one to the desired one, furthermore 100° C. or more in the heating medium tank 7. The warm water or steam thus obtained is fed and circulated by the circulating pump 8. Alternately, the warm water having the ordinary temperature to the higher one may be fed from the heating medium tank 7 to the heating medium header 6. In addition, the steam may be fed to the heating medium header 6 through another pipe. In this case, it is necessary to control the change of the warm water and the steam.

When the pressure is reduced to a desired one in the closed container 1 and the heating plate 14 is kept 30° to 60° C. by circulating the warm water having a temperature of 30° to 60° C., the solvent of the injected solution in the wood material W is gradually volatilized in the closed container 1. The solvent thus volatilized is introduced from the closed container 1 into the heat exchanger 19 through the suction pipe 18, and then is liquefied by the heat exchanger 19 and withdrawn in the condensate tank 20. A solvent volatilizing treatment is carried out in accordance with a heating schedule until the content rate of the solvent reaches a desired one, for example, 10 to 30%. In the heating schedule, pressure reduction and the temperature of the heating plate 14 are changed depending on the kind and thickness of the wood material W and the kind of the injected solution containing the solvent.

Thus, the solvent in the wood material W is volatilized by reducing the pressure in a low temperature region. Even if the solvent is combustible, therefore, there is no possibility that ignition is caused.

In the case where the solvent of the injected solution is to be volatilized, it is preferred that the high-frequency oscillator 22 is operated to perform the high-frequency heating by the heating plates 14*a*, 14*b* and 14*c* as electrodes in addition to the heating by the heating plates 14. The reasons are as follows. In the case where the wood material W is heated by only the heating plates 14 in the above-mentioned temperature range, the volatilizing speed of the solvent is made lower when solvent volatilization proceeds up to the fiber saturation point of the wood material W or less. Consequently, a lot of time is required to volatilize the solvent. In addition, the solvent cannot fully be volatilized. When the high-frequency heating is carried out in addition to the heating by the heating plates 14, however, the temperature is made higher in the central portion than in the surface layer portion of the wood material W and the portion having much solvent easily generates heat. In the case where the heat treatment is applied to the thick wood material in which the content rate of the solvent is high and the content distribution of the solvent is easily dispersed, therefore, the volatilization of the solvent can be made uniform and the solvent can be volatilized smoothly and rapidly.

As described above, the step of volatilizing the solvent in the wood material W is carried out for a proper time in the low temperature region. Then, the temperature of the heating plates 14 is increased in the state of pressure reduction or normal pressures. Thereafter, the injected solution in the wood material W is cured.

The steps of volatilizing the solvent and of curing the injected solution are continuously carried out. In the step of curing the injected solution, it is preferred that the degree of pressure reduction of the closed container 1 and the temperature-up speed of the heating plate 14 are properly controlled by a temperature controller, a program controller or the like correspondingly to the kind of the injected solution in the wood material W, the thickness of the wood material W or the like in similar to the step of volatilizing the solvent.

Referring to the step of curing the injected solution, there can be used as a heating medium the warm water in the heating medium tank 7, or the steam obtained by vaporizing the warm water or the steam in another pipe. When the heating medium having a high temperature is fed and circulated from the heating medium header 6 to the heating medium passageway 15 in the heating plate 14, the temperature of the heating plate 14 can be increased at a stretch such that the injected solution is cured.

In the case where the heating medium is to be changed from the warm water to the steam, the warm water, which remains in the pipe and medium passageway, is fed back to the heating medium tank 7 through the heating medium feedback passageway 10 or is discharged through a suitable drain passageway. In this case, the above-mentioned changing operation, the steam pressure, a feed quantity, the time for feed and the like are automatically controlled by a controller. The heating plates 14 are heated to 100° C. or more by the steam, so that the wood material W is heated completely and uniformly from its surface and back. Consequently, the injected solution in the wood material W is cured without causing the curing defective portions.

The wood material W is heated for a predetermined time so as to cure the injected solution. Then, cooling is forcibly carried out by naturally cooling the wood materials W in the closed container 1, or by changing the heating medium flowing in the heating plates 14 from the steam to the warm water so as to gradually decrease the temperature of the heating plates 14 such that the wood materials W are not adversely affected. Thereafter, the wood materials W are pulled out of the closed container 1 and are taken from the heating plates 14.

In the case where the solution, which is prepared on the curing condition of 100° C. or less, is to be injected into the wood materials W, it is natural that the heating should be carried out by the warm water.

Also in the step of curing the injected solution, it is preferred that the inside of the closed container 1 is kept in the state of desired pressure reduction so as to forcibly discharge the solvent remaining in the wood materials W and other volatilizing components out of the closed container 1. Alternately, the injected solution in the wood materials W may be cured by means of the heating medium by keeping the inside of the closed container 1 in the state of normal pressures. After the curing is carried out, the volatilizing components may be removed by reducing the pressure in the closed container 1.

In the step of curing the injected solution, the high-frequency oscillator 22 may be operated to heat the inside of the wood materials W by the high frequencies in addition to the heating of the heating plates 14 by the heating medium in similar to the step of volatilizing the solvent. The heating plate 14 is not heated by a heating wire but by the heating medium flowing through the heating medium passageway 15. Even if the high-frequency oscillator 22 is operated, therefore, the heating medium is not adversely affected. In case of the high-frequency heating, the temperature is controlled by the temperature controller. In the steps of volatilizing the solvent and of curing the injected solution, it is possible to select either the heating of the heating plates 14 by the heating medium or the heating by the heating medium and high frequencies in accordance with the heating schedule of the wood materials W.

In place of the warm water or steam, ethylene glycol, propylene glycol, silicon oil and the like can be used for the heating medium flowing through the heating medium passageway 15 in the heating plate 14. In consideration of costs and handling, it is preferred that the warm water is used.

While there has been described the case where the injected solution such as a synthetic resin solution in the wood material W is cured in the above-mentioned embodiment, the heating method and apparatus according to the present invention are not used for only curing the injected solution. Also in the case where the water in the wood material W is to be evaporated to dry the wood material W, the heating method and apparatus can also be used.

In that case, the following operation is preferable. More specifically, the vacuum pump 17 is operated to reduce the pressure in the closed container 1 to, for example, 30 to 60 Torr. The circulating pump 8 is operated to feed and circulate the warm water, which is heated to 30° to 60° C. in the heating medium tank 7, from the heating medium feeding passageway 9 to the heating medium passageway 15 in the heating plate 14 through the heating medium header 6. In addition, the high-frequency oscillator 22 is operated to dry the wood material W.

There will be described the specific examples of the present invention.

EXAMPLE 1

As a material is prepared a Western hemlock lumbering product having a thickness of 27 mm, a width of 100 mm and a length of 1.8 m. A dehydrating condensation type resin solution (phenol resin) is injected into the material at an ordinary temperature. Then, two lumbering products, into which the resin solution is injected, are respectively provided between the heating plates 14 with being overlapped with each other, and are housed in the closed container 1.

Subsequently, the flexible connection pipes 16 are connected to the heating plates 14. In addition, the conductors 23 of the high-frequency oscillator 22 are connected to the heating plates 14. The heating plates 14 are connected to minus and plus electrodes for oscillating high frequencies. Then, the warm water is fed and circulated to the heating plates 14 through the flexible connection pipes 16 so as to carry out a pressure reduction heat treatment at a pressure reduction of 50 Torr and the temperature of the heating plate 14 of about 45° C., and to intermittently oscillate the high frequencies.

When the material is dried to have the water content of about 30%, the temperature of the warm water is increased by stages so as to increase that of the heating plate 14 and to adjust the pressure reduction depending on the temperature of the heating plate 14. Thus, the material is further dried. Also in this case, the high frequencies are intermittently oscillated.

When the material is dried to have the water content of about 10%, the heating medium is changed from the warm water to the steam so that the temperature of the heating plate 14 is increased by stages. When the temperature of the material reaches a predetermined one (140° C.), the material is held at the predetermined temperature for a predetermined time (3 hours) so as to cure the synthetic resin solution.

Then, the heat treatment is stopped so that the material is gradually cooled to decrease its temperature. Thus, the inside of the closed container 1 has a normal pressure again, so that a reformed material can be obtained.

EXAMPLE 2

As a material is prepared a Western hemlock lumbering product having a thickness of 27 mm, a width of 100 mm and a length of 1.8 m. A resin solution is injected into the material at an ordinary temperature. The resin solution consists of a dehydrating condensation type phenol resin solution (having the density of solid content of 10%) of 100 parts by weight and paratoluenesulfonic acid as a curing agent of 0.5 part by weight. Then, two lumbering products, into which the resin solution is injected, are respectively provided between the heating plates 14 with being overlapped with each other, and are housed in the closed container 1.

Subsequently, the flexible connection pipes 16 are connected to the heating plates 14. In addition, the conductors 23 of the high-frequency oscillator 22 are connected to the heating plates 14. The heating plates 14 are connected to minus and plus electrodes for oscillating high frequencies. Then, the warm water is fed and circulated to the heating plates 14 through the flexible connection pipes 16 so as to carry out a pressure reduction drying treatment for 5 days at a pressure reduction of 50 Torr and the temperature of the heating plate 14 of about 45° C., and to intermittently oscillate the high frequencies.

When the material is dried to have the water content of about 30%, the temperature of the warm water is increased from about 45° C. to about 90° C. by stages so as to increase that of the heating plate 14. The material is held for about 1 day at the temperature (80° to 90° C.) which is sufficient to cure the synthetic resin solution. Consequently, the resin solution is cured.

Then, a heat treatment is stopped so that the material is gradually cooled to decrease its temperature. Thus, the inside of the closed container 1 has a normal pressure again, so that a reformed material can be obtained.

EXAMPLE 3

In similar to Example 1, a resin solution is injected into a Western hemlock lumbering product. On the same treatment conditions as in Example 1, the lumbering product is subjected to a heat treatment without high frequencies. Thus, a reformed material can be obtained.

Although the present invention has fully been described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A method for heating a wood material comprising steps of;

holding the wood material, into which a synthetic resin solution is injected from its surface and back, in a closed container by heating plates having heating medium passageways through which a heating medium flows, volatilizing a solvent from an injected solution in the wood material by reducing a pressure in the closed container and by making a heating medium flow through the heating medium passageways, the heating medium having a temperature which volatilizes the solvent of the injected solution.

2. A method for heating a wood material according to claim 1, wherein the step of volatilizing the solvent from the injected solution in the wood material includes a step of continuously or intermittently oscillating high frequencies to the wood material to dielectrically heat the wood material.

3. A method for heating a wood material comprising steps of;

holding the wood material from its surface and back in a closed container by heating plates having heating medium passageways through which a heating medium flows, and drying the wood material by reducing a pressure in the closed container, by making the heating medium, having a temperature which volatilizes water in the wood material, flow through the heating medium passageways, and by at least intermittently oscillating high frequencies to the wood material.

4. A method for heating a wood material according to claim 3, wherein high frequencies are continuously oscillated to the wood material.

5. An apparatus for heating a wood material comprising;

a plurality of heating plates provided with heating medium passageways, through which a heating medium flows, for holding the wood material from their surfaces and backs, a closed container for housing the heating plates which hold the wood material, pressure reduction means for reducing a pressure in the closed container, and heating medium feeding means capable of adjusting a heating temperature which is provided outside the closed container for selectively feeding a heating media having different temperatures to the heating medium passageways through feed pipes.

6. An apparatus for heating a wood material according to claim 5, further comprising high-frequency oscillating means for oscillating high frequencies to the wood material held by the heating plates to dielectrically heat the wood material.

7. An apparatus for heating a wood material according to claim 6, further comprising pressure fastening means for pressuring the heating plates, which hold the wood material, from their surfaces and backs by pressures.

8. An apparatus for heating a wood material comprising;

a plurality of heating plates provided with heating medium passageways, through which a heating medium flows, for holding the wood materials having the injected synthetic resin solution from their surfaces and backs, a closed container for housing the heating plates which hold the wood material, pressure reduction means for reducing a pressure in the closed container, heating medium feeding means for feeding a heating medium to the heating medium passageways, the heating medium having a temperature which volatilizes a solvent of said injected synthetic resin solution, control means for controlling the heating medium feeding means to feed heating medium to the heating medium passageways.

9. An apparatus for heating a wood material according to claim 8, further comprising high-frequency oscillating means for oscillating high frequencies to the wood material held by the heating plates so as to dielectrically heat the wood material.

10. An apparatus for heating a wood material according to claim 9, further comprising pressure fastening means for pressuring the heating plates, which hold the wood material, from their surfaces and backs by pressures.

11. An apparatus for heating a wood material comprising;

a plurality of heating plates provided with heating medium passageways, through which a heating medium flows, for holding the wood material from their surfaces and backs, a closed container for housing the heating plates which hold the wood material, pressure reduction means for reducing a pressure in the closed container, heating medium feeding means for feeding the heating medium to the heating medium passageways, and high-frequency oscillating means for oscillating high frequencies to the wood material held by the heating plates so as to dielectrically heat the wood material.

12. An apparatus for heating a wood material according to claim 11, further comprising pressure fastening means for pressuring the heating plates, which hold the wood material, from their surfaces and backs by pressures.

* * * * *